US007094032B2

(12) United States Patent
Seleski

(10) Patent No.: US 7,094,032 B2
(45) Date of Patent: Aug. 22, 2006

(54) TURBINE BLADE SHROUD CUTTER TIP

(76) Inventor: Richard Seleski, 309 Balsam St., Palm Beach Gardens, FL (US) 33410

( * ) Notice: Subject to any disclaimer, the term of this patent is extended or adjusted under 35 U.S.C. 154(b) by 0 days.

(21) Appl. No.: 10/787,558

(22) Filed: Feb. 26, 2004

(65) Prior Publication Data

US 2005/0191182 A1 Sep. 1, 2005

(51) Int. Cl.
*F01D 11/12* (2006.01)

(52) U.S. Cl. ..... 416/192; 415/173.6

(58) Field of Classification Search ..... 416/192; 415/173.6

See application file for complete search history.

(56) References Cited

U.S. PATENT DOCUMENTS 5,083,903 A 1/1992 Erdmann
6,491,498 B1 * 12/2002 Seleski et al. ..... 416/192
6,805,530 B1 * 10/2004 Urban ..... 415/173.6
6,857,853 B1 * 2/2005 Tomberg et al. ..... 416/192
6,890,150 B1 * 5/2005 Tomberg ..... 415/173.4
6,913,445 B1 * 7/2005 Beddard et al. ..... 416/192
2005/0175453 A1 * 8/2005 Dube et al. ..... 416/97 R

* cited by examiner

*Primary Examiner*—Edward K. Look
*Assistant Examiner*—Richard A. Edgar

(57) ABSTRACT

A shroud for use with a turbine blade is disclosed wherein the shroud provides at least one knife edge with at least one tooth for cutting a groove in a compliant rub strip that minimizes wear on the knife edge. The tooth is positioned along the knife edge inward of the ends of the knife edge and a distance from an airfoil stackline such that the moment created by the tooth mass and its effect on shroud bending stress is significantly reduced, thereby resulting in increased turbine blade durability.

16 Claims, 2 Drawing Sheets

TURBINE BLADE SHROUD CUTTER TIP

TECHNICAL FIELD

This invention relates to shrouded turbine blades and more specifically to an improved cutter tip design that reduces the bending stresses in the shroud to airfoil interface region of a turbine blade.

BACKGROUND OF THE INVENTION

Gas turbine engines have compressor and turbine blades of varying length in order to compress and expand the fluid flow passing through the engine. For the turbine section, as energy is extracted from the hot combustion gases, the fluid expands and the turbine section expands accordingly, including the stages of turbine blades. As turbine blade length increases, the blades become more susceptible to vibration and require dampening. In order to dampen the vibrations, a shroud is added to the blade, most often at the blade tip. The shroud serves to reduce blade vibrations by interlocking adjacent turbine blade tips, as well as to seal the blade tip region to prevent hot combustion gases from leaking around the blade tip and bypassing the turbine.

While this sealing and dampening design is effective, the use of a shroud causes additional load and stress on the turbine blade due to its shape, weight, and position. Specifically the shroud has a radial stress component on the blade attachment due to its weight and radial position. Furthermore, the shroud exhibits a bending moment at the interface region between the shroud and airfoil due to the large mass cantilevered along the edges of the shroud. This bending moment is further complicated by the mass due to a cutter tooth located along at the edge of the shroud knife edge. As the operating temperature of the turbine blade increases, it stretches radially outward and approaches an outer compliant rub strip that surrounds the row of turbine blades. The rub strip is typically fabricated from segments of honeycomb. The cutter tooth is designed to cut a groove in the honeycomb of the surrounding rub strip to allow the shroud sufficient area under all operating conditions to seal and not adversely contact the rub strip. Depending on the size and position of the cutter tooth, the bending moment between the shroud and airfoil increases, and the associated shroud bending stresses will increase by as much as 20%, thereby reducing the durability of the shroud.

An example of this type of shroud design is shown in FIG. 1. A shroud 10 is fixed to airfoil 11. Extending radially outward from shroud 10 is knife edge 12 having a cutter tooth 13 located at one end thereof. As discussed previously, cutter tooth 13 is designed to cut a groove in the honeycomb of the surrounding compliant rub strip to allow the shroud sufficient area under all operating conditions to seal and not adversely contact the rub strip. In this prior art shroud design, cutter tooth 13 is positioned at one end of knife edge 12 and while it cuts a sufficient groove into the surrounding rub strip for knife edge 12, cutter tooth 13 causes a large bending moment at the airfoil to shroud interface due to the distance from the center of the shroud to the cutter tooth. The present invention seeks to overcome the shortcomings of the prior art by providing a turbine blade shroud configuration having a cutter tooth design that results in lower shroud bending stresses.

SUMMARY AND OBJECTS OF THE INVENTION

A shrouded turbine blade having reduced bending stresses at the blade tip region is disclosed. In general, the turbine blade comprises an attachment, neck, platform, airfoil, and shroud. More specifically, the shroud comprises a first surface fixed to an end of the airfoil, a second surface in spaced relation and generally parallel to the first surface, with a plurality of radially extending sidewalls connecting the first surface and second surface to give the shroud a thickness. Extending outward from the shroud second surface and across the second surface is at least one knife edge having knife ends at the shroud sidewalls. Positioned immediately adjacent the at least one knife edge yet inward of the knife ends and a distance from an airfoil stackline is at least one tooth used for cutting a groove in a compliant rub strip that surrounds the turbine blade tip.

The tooth, which in prior art shroud designs, has been known to be a significant factor in shroud bending stresses, is repositioned to reduce its bending moment on the airfoil to shroud region and associated shroud bending stresses. It has been determined that the tooth can be repositioned without compromising cutting performance, while at the same time reducing shroud bending stresses for the preferred embodiment by approximately 18% over the prior art configuration.

It is an object of the present invention to provide a shrouded turbine blade having lower shroud bending stresses.

It is another object of the present invention to provide a shrouded turbine blade with smaller clearances between the blade tip and surrounding seal.

In accordance with these and other objects, which will become apparent hereinafter, the instant invention will now be described with particular reference to the accompanying drawings.

DETAILED DESCRIPTION OF THE PREFERRED EMBODIMENT

Figure 1:
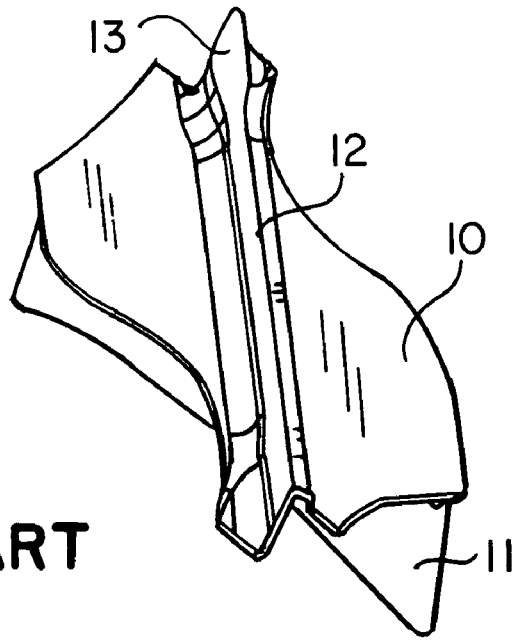
FIG. 1 PRIOR ART
FIG. 1 is a perspective view of a turbine blade shroud of the prior art.
Figure 2:
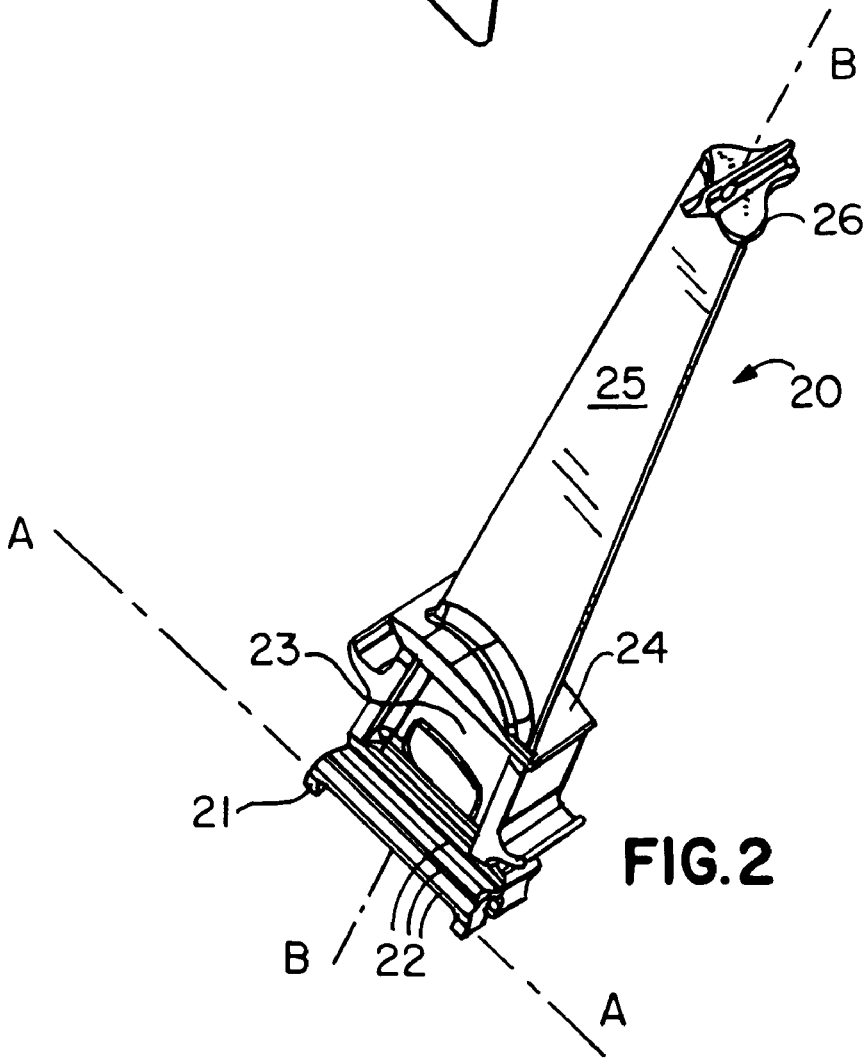
FIG. 2 is a perspective view of a turbine blade incorporating a shroud in accordance with the present invention.
Figure 3:
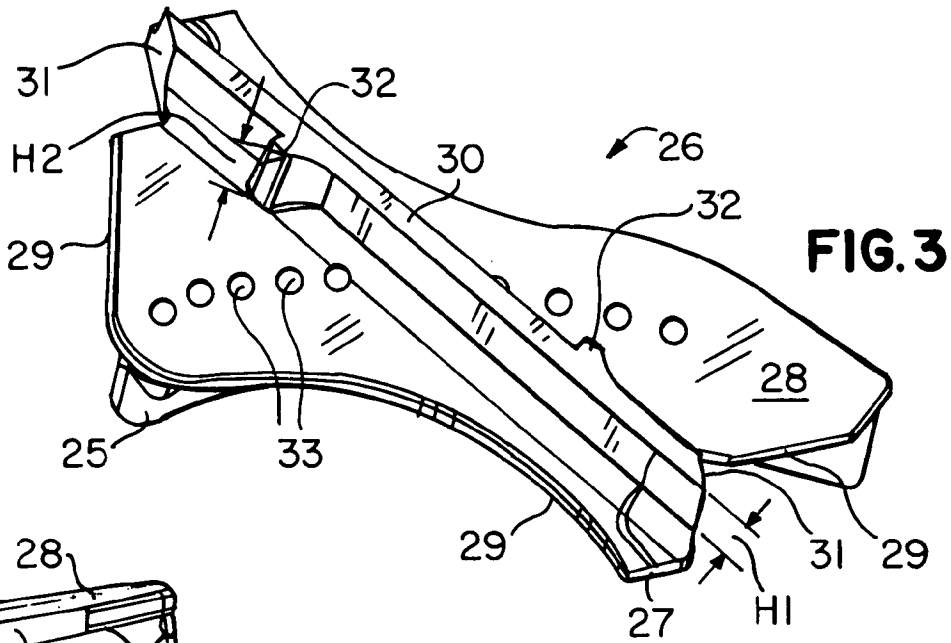
FIG. 3 is a detailed perspective view of a turbine blade shroud in accordance with the present invention.
Figure 4:
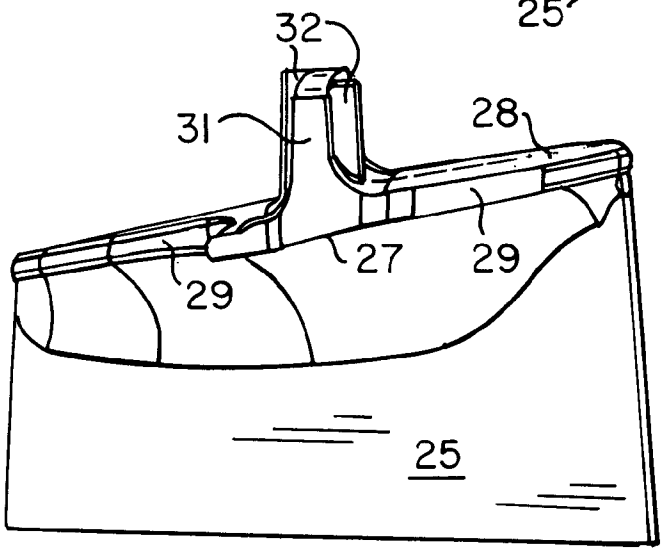
FIG. 4 is an elevation view of a tip portion of a turbine blade in accordance with the present invention.

Referring to FIG. 2, a turbine blade 20 incorporating the present invention is shown. Turbine blade 20 comprises an attachment 21 that extends generally parallel to an axis A—A and has a plurality of serrations 22 for attaching turbine blade 20 to a blade disk (not shown). In the preferred embodiment, serrations 22 are generally parallel to axis A—A. Extending radially outward from attachment 21 is a region 23 commonly referred to as a blade neck. Neck 23 connects to platform 24, which is generally planar in shape. Extending radially outward from platform 24 is airfoil 25, wherein airfoil 25 also includes a generally radially extending stacking line B—B through which sections of the airfoil are stacked to create airfoil 25. Referring now to FIGS. 3 and 4, extending radially outward from airfoil 25 is shroud 26 with the shroud comprising a first surface 27 fixed to airfoil 25 at an end opposite of platform 24, a second surface 28 in spaced relation to and generally parallel to first surface 27. Extending radially between and generally perpendicular to first surface 27 and second surface 28 is a plurality of sidewalls 29. Fixed to and extending radially outward from second surface 28 is at least one knife edge 30, where knife edge 30 extends across second surface 28, has a first height H1, and knife ends 31 proximate sidewalls 29. In the preferred embodiment, knife edge 30 extends across second surface 28 such that knife edge 30 is generally perpendicular to axis A—A.

Positioned immediately adjacent knife edge 30, inward of knife end 31 and a distance from airfoil stacking line B—B, is at least one tooth 32, as shown in FIG. 2. At least one tooth 32 has a second height H2, that is substantially equal to knife edge first height H1, as can be seen in FIGS. 3 and 4. At least one tooth is positioned adjacent the knife edge of a turbine blade shroud in order to cut a groove in a surrounding compliant rub strip for the relatively thin knife edge of the shroud such that a seal between the turbine blade and surrounding rub strip is provided. Cutting a slot wider than the width of the knife edge ensures the thinner knife edge will not contact the rub strip and adversely wear. Cutting a wider slot with margin on either side of the knife edge to compensate for shroud movement can be accomplished by multiple cutter teeth as shown in FIG. 3. In this configuration, teeth 32 are spaced apart along knife edge 30 an equal distance from stacking line B—B of airfoil 25 in order to provide a more even stress distribution. In the preferred embodiment of the present invention, knife edge 30 and at least one tooth 32 are both integrally cast into turbine blade 20. Although being cast into the turbine blade, typically the height of the tooth and knife edge are determined by a final blade machining process.

Depending on the operating temperatures of the turbine, often times turbine blades require cooling in order to reduce the overall blade temperature to an acceptable level for the blade material. An example of blade cooling is shown in FIGS. 2–4, where turbine blade 20 includes a plurality of cooling holes 33 that extend radially from attachment 21 through neck 23, platform 24, airfoil 25, and to shroud 26 in order to provide a cooling fluid to turbine blade 20. Depending on the cooling requirements, compressed air or steam can be used to cool the turbine blade, but for the embodiment disclosed in FIGS. 2 and 3, compressed air is the preferred cooling medium.

Figure 5:
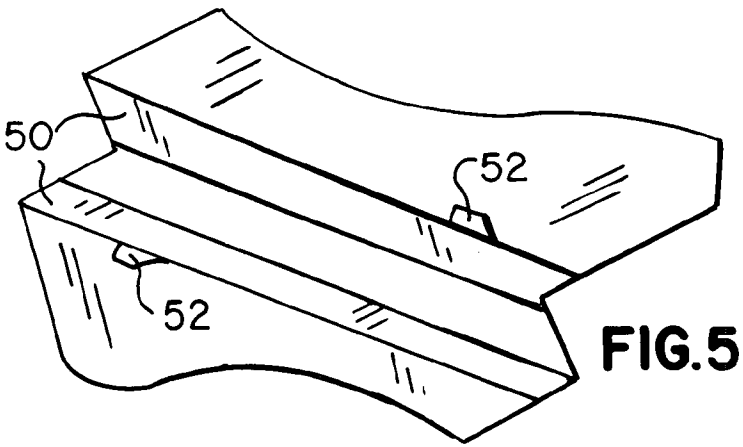
FIG. 5 is a top view of a shroud in accordance with an alternate embodiment of the present invention.

Depending on the size of the turbine blade shroud, more than one knife edge may be necessary in order to provide an effective seal between the turbine blade and surrounding compliant rub strip. An example of this alternate shroud configuration is shown in FIG. 5. Shroud 46 includes all of the elements of the preferred embodiment of the shroud, but instead of a single knife edge, utilizes a pair of knife edges 50 that are parallel to one another. Furthermore, each knife edge includes at least one tooth 52 for cutting a path in a compliant rub strip that surrounds the turbine blades containing shrouds 46.

One skilled in the art of turbine blade design will understand that the use of this type of shroud configuration is independent of the turbine blade geometry. Therefore, the shroud and knife edge geometry disclosed herein could be used in combination with other airfoil, platform, neck, and attachment configurations.

While the invention has been described in what is known as presently the preferred embodiment, it is to be understood that the invention is not to be limited to the disclosed embodiment but, on the contrary, is intended to cover various modifications and equivalent arrangements within the scope of the following claims.

I claim:

1. A turbine blade having reduced bending stresses at a blade tip region, said turbine blade comprising:

an attachment extending generally parallel to an axis and having a plurality of serrations generally parallel with said axis;

a neck extending radially outward from said attachment;

a platform of generally planar shape extending radially outward from said neck;

an airfoil extending radially outward from said platform and having a generally radially extending stacking line;

a shroud extending radially outward from said airfoil, said shroud comprising:

a first surface fixed to said airfoil opposite said platform;

a second surface in spaced relation to and generally parallel to, said first surface;

a plurality of radially extending sidewalls, generally perpendicular to, and connecting said first and second surfaces;

at least one knife edge extending outward from said second surface, said knife edge extending across said second surface, having a first height, and knife ends at said sidewalls; and, at least one tooth positioned immediately adjacent said at least one knife edge inward of said knife ends and a distance from said stacking line.

2. The turbine blade of claim 1 further comprising a plurality of cooling holes extending radially from said attachment, through said neck, platform, and airfoil, to said shroud in order to provide a cooling fluid to said turbine blade.

3. The turbine blade of claim 2 wherein said cooling fluid is compressed air.

4. The turbine blade of claim 1 wherein said at least one tooth has a second height substantially equal to said first height of said knife edge.

5. The turbine blade of claim 1 wherein said at least one knife edge and said at least one tooth are integrally cast into said turbine blade.

6. The turbine blade of claim 1 wherein said at least one knife edge is generally perpendicular to said axis.

7. The turbine blade of claim 1 wherein said at least one tooth comprises two teeth.

8. The turbine blade of claim 7 wherein said distance said teeth are spaced apart along said knife edge from said stacking line of said airfoil is equal.

9. The turbine blade of claim 1 wherein said at least one knife edge comprises two parallel knife edges.

10. A shroud for use with a turbine blade for reducing bending stresses at a blade tip region, said shroud comprising:

a first surface fixed to an airfoil, said airfoil having a stacking line extending therethrough;

a second surface in spaced relation to and generally parallel to, said first surface;

a plurality of radially extending sidewalls, generally perpendicular to, and connecting said first and second surfaces;

at least one knife edge extending outward from said second surface, said knife edge extending across said second surface, having a first height, and knife ends at said sidewalls; and, at least one tooth positioned immediately adjacent said at least one knife edge inward of said knife ends and a distance from said stacking line.

11. The shroud of claim 10 wherein said at least one tooth has a second height substantially equal to said first height of said knife edge.

12. The shroud of claim 10 wherein said at least one knife edge and said at least one tooth are integrally cast into a turbine blade.

13. The shroud of claim 10 wherein said at least one knife edge is generally perpendicular to an axis of a turbine blade.

14. The shroud of claim 10 wherein said at least one tooth comprises two teeth.

15. The shroud of claim 14 wherein said distance said teeth are spaced apart along said knife edge from a stacking line of a turbine blade airfoil is equal.

16. The shroud of claim 10 wherein said at least one knife edge comprises two parallel knife edges.

* * * * *